US006227587B1

(12) United States Patent
Terral

(10) Patent No.: US 6,227,587 B1
(45) Date of Patent: May 8, 2001

(54) COMBINED WELL CASING SPIDER AND ELEVATOR

(75) Inventor: Ben D. Terral, Livingston, TX (US)

(73) Assignee: Emma Dee Gray, Jenna, LA (US)

( * ) Notice: Subject to any disclaimer, the term of this patent is extended or adjusted under 35 U.S.C. 154(b) by 0 days.

(21) Appl. No.: 09/106,157

(22) Filed: Feb. 7, 2000

(51) Int. Cl.[7] ..... B66C 1/48; E21B 19/07
(52) U.S. Cl. ..... 294/102.2; 188/67
(58) Field of Search ..... 294/102.1, 102.2, 294/86.19, 86.2, 86.26, 86.28, 86.3, 90, 116; 188/67

(56) References Cited

U.S. PATENT DOCUMENTS

| | | | | |
|---|---|---|---|---|
| 1,966,454 | * | 7/1934 | Moody | 294/102.2 |
| 2,030,087 | * | 2/1936 | Young et al. | 294/102.2 |
| 4,253,219 | * | 3/1981 | Krasnov | 294/102.2 |
| 4,275,488 | | 6/1981 | Gray et al. . | |
| 5,669,653 | * | 9/1997 | Penisson | 294/116 |

* cited by examiner

*Primary Examiner*—Dean J. Kramer
(74) *Attorney, Agent, or Firm*—James L. Jackson; Mayor, Day, Caldwell, & Keeton, LLP

(57) ABSTRACT

A combined well casing spider and elevator has a body defining a bowl inner wall tapered to reduced diameter from the top to bottom end and defining first external guide surfaces being inclined upwardly and outwardly and having a kicker element defining a second coextensive external guide surface being inclined upwardly and outwardly to a greater extent than the first external guide surface. A gate member is pivoted to the body for movement of a well casing to and from the bowl. A circumferential array of casing gripping slips is located within the bowl and form a circular hole to receive a well casing. The slips are vertically movable along the bowl inner wall to effect radial enlargement and contraction of the circular hole to release and grip the casing. A slip actuating mechanism is provided having a cross-rod extending across the body and having end portions received within journal bushings fixed within the body and also having crank arms fixed to the cross-rod and lift arms being moved by the lift arms for raising and lowering the slips. Wear resistant polymer guide pads of the lift arms have guiding engagement with the first and second external guide surfaces of the body during upward movement of the lift arms to cause first and second segments of upward spreading movement of the lift arms and the slips during upward lift arm movement to cause first and second segments of upward and radially spreading movement of the slips. The cross-rod incorporates positioning shoulders and jamb nuts which ensure maintenance of proper adjustment of the crank arms relative to the cross-rod. A wear resistant latch mechanism is also provided for latching and releasing the slips.

20 Claims, 5 Drawing Sheets

COMBINED WELL CASING SPIDER AND ELEVATOR

CROSS REFERENCE TO RELATED PATENT

This application is based on an invention being an improvement over the subject matter set forth in U.S. Pat. No. 4,275,488 of Charles E. Gray, issued on Jun. 30, 1981, and entitled "Combined Well Casing Spider And Elevator".

BACKGROUND OF THE INVENTION

1. Field of the Invention

The present invention generally relates to oil well casing handling mechanisms referred to as spiders and elevators, which are used in the well drilling industry to effect the insertion and removal of drill stem and well casing segments into and from well bores of oil and gas wells, and more particularly to a combined well casing spider and elevator which may be used interchangeably as the spider or the elevator and having a laterally pivotal gate member which permits ease in the entry and removal of a drill stem and/or well casing segment. Even more specifically, the present invention incorporates means for achieving enhanced slip opening characteristics while preventing inward tilting of the slips and means providing for controlled spider operation while minimizing wear of spider actuating components and also means for ensuring smooth release of the slip open latch with which the spider and elevator mechanism is provided.

2. Background of the Invention

In the specification and the appended claims, reference will only be made to the gripping, release, insertion and removal of a well casing, but it is to be expressly understood that the combined well casing spider and elevator according to the invention is not limited in its use to well casings alone and can be used with well casings, drill stems and other pipe or rod-like members.

To effect the lowering and raising of long strings of well pipe such as oil well casings, a spider is conventionally mounted over the rotary table on the working platform of an oil well drilling derrick. The spider is operable to grip or release a segment of the well casing by the action of slips which provide a gripping and holding action as a downward force is applied to the slips by the weight of the casing and release the gripping and holding action as the casing is moved upwardly relative to the spider. An elevator attached to a hoist co-operates with the spider in the lowering and raising of well casing and is also operable to grip or release the well casing. Well casing is removed, for example, by lowering of the elevator so that it can grip the end of the well casing extending above the spider. The spider then releases the well casing and the elevator is hoisted until the end of the next segment of well casing extends above the spider. The spider again grips the well casing, and the casing segment removed by the elevator is disconnected by rotating and unthreading it. This segment can then be off loaded from the drilling rig to a pipe rack located adjacent the rig, thus allowing the elevator to be again lowered to grip the end of the well casing projecting above the spider to repeat the process.

Conventionally, a casing spider is provided with a plurality of arcuate wedge-shaped scepter-like elements of slips formed of cast metal such as steel which are borne by a spider bowl which is hollow and whose interior surface tapers upwardly and outwardly. These slips ride on the internal tapered surface of the spider bowl, being normally keyed thereto, and means is provided for raising and lowering of the slips in contact with the tapered surface of the hollow spider bowl such that, when the slips are raised, they are caused to move radially away from each other to increase the size of the opening defined by the slips through which passes the well casing. Conversely, when the slips are lowered with respect to the spider bowl defined by the spider housing the slips are caused to move radially toward one another so that the inner gripping surfaces of each of the slip segments moves into gripping relation with the casing. One such type of well spider is shown in U.S. Pat. No. 2,274,273, issued Feb. 24, 1942, to Earl J. Miller.

Though the combined spider and elevator set forth in the '488 Patent of Gray effectively overcomes deficiencies of the well spider mechanism of the '273 Patent of Miller by combining the features of a well casing spider and an elevator in a single unit having a lever operated lift mechanism for moving driven and floating slip segments to the radially expanded or release positions thereof, it has been determined that certain shortcomings of the spider-elevator mechanism of Gray exist which warrant improvement. The '488 Patent of Gray teaches the use of rollers carried by lift arms which react against external upwardly and outwardly tapered surfaces of the main body and which move the lift arms and thus the slips outwardly to the casing releasing positions thereof. Though the slip segments are moved to their retracted or open positions, thus releasing the casing, radial slip movement is slight so that it may be difficult to run a section of casing into the slip opening. Additionally, due to the loose tolerance of fit of the slips with the slip guide slots of the body or bowl structure, the slips, or some of them, can tilt inwardly with the upper ends thereof essentially closing the slip opening or at least interfering with movement of the casing into the slip opening. When this undesirable condition exists the downwardly moving casing can strike the slip segment in a manner causing damage to the slip segments, the casing or both. Accordingly, it is desirable to provide a spider-elevator mechanism having the capability of forcing the upper ends of the slips radially outwardly to an extent overcoming inadvertent slip closing movement and positively positioning the slip segments at a "more open" retracted position than is typically accomplished and preventing any inward tipping of any of the slip segments so that the slips will not interfere with movement of casing into the slip opening.

According to present practice the spider-elevator assembly of Gray has been manufactured using guide rollers which ride on outwardly facing guide surfaces of the housing or bowl and being shown at 106 in FIG. 5 of the '488 patent of Gray. These guide rollers readily become fouled, worn and require frequent replacement due to the presence of abrasive particulate such as drilling fluid, sand, dirt, dust and grease on the working floor of a drilling rig. In practice, because of the presence of abrasive particulate from drilling fluid, grease and other contaminants about casing spiders which cause rapid deterioration of roller bearings or bushings, the combination spider and elevator mechanism of Gray has been manufactured with actuating bosses on the lifting arms which replace the actuating rollers shown at 106 in the '488 Patent. These actuating bosses are in sliding contact with external upwardly and outwardly inclined guide or cam surfaces of the main spider body to provide the same slip spreading function as the rollers 106. It has been found however that the actuating bosses, being composed of metal and having sliding contact with externally facing body surfaces and operating in the presence of abrasive particulate, while more serviceable as compared with rollers, nevertheless are subject to accelerated wear of both the actuating bosses and the external guide or cam surfaces of the body structure. It is desirable therefore to provide slip expanding means which is not subject to exceptional wear, even in the presence of abrasive particulate, grease and other contaminants often found on well drilling rigs and which provides an efficient slip spreading function to ensure optimum positioning of the slip members, especially in the upward and radially retracted positions thereof.

As the slips of the combined well casing spider and elevator tend to reach the upward extent of the releasing movement thereof, the slips typically have minimal supported contact with the tapered inner surface of the main body and thus are susceptible to the upper portions of the slips tilting radially inwardly to positions potentially interfering with casing that is being lowered into the central opening of the well casing spider. To simply increase the height of the interrelating tapered surfaces of the main body or bowl and the slips would require significant increase in the overall height of the spider and would therefore be undesirable because vertical space requirement are critical on most drilling rigs. It is desirable therefore to provide a combined well casing spider and elevator which has the capability for causing significant radial expansion of the slips and which overcomes the problem of the upper ends of the slips tilting inward when the slips are opened, without requiring an increase in the overall height of the spider body or the slips.

The combined well casing spider and elevator of the '488 Patent of Gray incorporates a locking mechanism for locking the slip mechanism in the upward, release position thereof. As the slip operating lever 62 is pivoted downwardly about the cross-rod 60, moving the crank arm pivotally to the open position shown in FIG. 4B, the spring loaded indent pin 114 will rotate to its locking position with respect to a hardened steel plate 144 located at the bottom edge of the crank arm. To release the crank arm from this locked position, the indent pin is rotated against the bias of its compression spring 140, causing the tapered camming surface 146 to react with the hardened steel plate 144 as shown in FIG. 12A and drive the pin 114 linearly to release the crank arm and allow it to pivot as the weight of the slips moves the crank arm back to the broken line position of FIG. 3. It has been determined that accelerated wear of the tapered indent pin, especially at the tapered surface 146 and the intersection with the tapered surface 146 with the cylindrical pin surface occurs as the pin is rotated to its release position by rotating the release arm 74 by pulling on the lanyard 72. It is desirable therefore to provide a tapered indent pin that resists wear as it is rotated from its latched position to its release position.

The cross-shaft of the slip raising and lowering mechanism extends across the body structure, with the shaft ends being supported by journal bushings. On one side of the body structure one of the crank arms is secured to the cross-shaft at a location adjacent one of the journal bushings. At the opposite side of the body structure the opposite crank arm is secured to the cross-shaft at a location adjacent the other journal bushing and the actuating lever 62 is then fixed to the cross-shaft at a location outboard of the body structure. During extended operation of the spider-elevator unit it was found that the crank arms would move linearly relative to the cross-shaft and thus one or both of the crank arms could get out of adjustment with the cross-shaft, thus causing uneven raising and lowering of the slips. It is thus desirable to provide a cross-shaft assembly which is designed for positive location of the crank arms with respect to the cross-shaft and which prevents linear movement of the crank arms on the cross-shaft. This feature effectively prevents the slip raising and lowering mechanism from getting out of adjustment during normal operating conditions of the spider-elevator mechanism.

SUMMARY OF THE INVENTION

It is, therefore, a feature of the present invention to provide a combined well casing spider and elevator mechanism having a slip actuating mechanism that effectively achieves open positioning of the slip segments thereof so that the upper ends of the slips are radially extended to significantly increase the upper extent of the spider opening and thereby enhance the capability for casing entry through the spider opening into the well.

It is another feature of the invention to provide a combined well casing spider and elevator which, when used as a spider, can be quickly positioned with respect to the well casing without the necessity of vertically raising the spider above the casing and which can be moved into casing encompassed position at any desired vertical level with respect to the casing.

It is a further object of the invention to provide a combined well casing spider and elevator which may be moved laterally relative to the well casing to effect the surrounding of the well casing by the slips which grip the casing.

It is another feature of the present invention to provide a combined well casing spider and elevator which incorporates a slip actuating mechanism having the capability for enhancing spreading of the upper ends of the slips as the slips reach the final extent of their upward movement relative to the body or bowl to ensure against the potential for any of the upper ends of the slips to become inwardly inclined to positions interfering with movement of the casing into and through the central opening of the spider mechanism.

It is another feature of the present invention to provide a combined well casing spider and elevator which provides wear resistant means for guided slip expanding engagement with body guide surfaces and which resists wear of the guide surfaces of the body and the guide elements of the slip lift and positioning arms during slip lifting and lowering activities.

It is another feature of the present invention to provide a combined well casing spider and elevator which incorporates an indent pin controlled latch mechanism for latching the spider in its open condition and for releasing the slips for downward closing movement, while at the same time minimizing wear of the latch mechanism and promoting the extensive service life of the spider-elevator unit.

It is an even further feature of the present invention to provide a combined well casing spider and elevator which incorporates a slip lifting and lowering mechanism having a cross-shaft defining outwardly facing crank arm positioning shoulders and having the crank arms in secure engagement with the positioning shoulders by jamb nuts which prevent the crank arms from linear movement on the cross-shaft during use and therefore minimize the potential for the crank arms getting out of adjustment during normal use.

These and other objects and features of the present invention are attained by providing a main body including a base wall, a top wall, a pair of lateral walls, a first end wall and a second end wall, the second end wall having two sections spaced from one another. The main body further includes a bowel inner wall tapered to minimize the wall diameter from the top wall to the bottom wall. A gate member is pivotally secured to one of the sections of the second end wall and releasably secured to the other of the sections to connect the sections when in a secured position. The gate member pivots laterally when released to permit the lateral entry of a well casing within the area defined by the bowl inner wall. The gate member has a gate inner wall which co-operates with the bowl inner wall to comprise a bowl section. A circumferential array of casing gripping slips are arranged in opposing pairs for vertical and radial mounting in surface contact with the bowl inner wall. As the gripping slips from a circular hole within the center thereof to receive a well casing and are vertically movable along the bowl inner wall to effect radial enlargement and contraction of the circular hole formed thereby by upward and downward movement respectively to release and grip the casings. A cross rod spans the main body and extends into bearing journals attached to each of the lateral walls of the main body. A lever is fixedly attached to the cross rod and is vertically movable to rotate the cross rod adjacent either lateral wall and movable with the cross rod to rotate in respective vertical planes. First and second lift arms are pivotally connected at one end to the first and second crank arms and pivotally connected at the other end to the upper end of a pair of diametrically opposed gripping slips. The lift arms are each provided with a wear resistant guide member which has sliding and guided contact with corresponding external guide surface of the body. First opposed external segments of the body guide surfaces are inclined upwardly and outwardly and are engaged by the wear resistant guide members of the lift arms to achieve outwardly pivoting movement of the lift arms and consequent outwardly inclining "opening" movement of the slips during slip lifting activity by the lift arms. To ensure an exceptionally wide outward tilting and opening movement of the slips, second opposed external segments of inclined guide surface are provided, having a greater angle of inclination as compared to the angles of the first opposed external guide surfaces. These second opposed external segments of inclined guide surface provide a "kicking" function to significantly increase the angulation of the slips and the central opening defined thereby so that none of the slips will become inwardly inclined and interfere with casing movement into the central opening defined by the spider. These second opposed external segments of inclined guide surface also function to achieve significant slip opening movement without requiring exceptional additional height of the spider body or exceptional additional length of the slips. Also, the structure defining the second opposed external segments of inclined guide surface may be defined integrally with the body structure, such as for originally manufactured equipment or may be defined by "kicker blocks" which may be bolted, welded or otherwise attached to the body, such as for remanufacture of existing spider-elevator equipment to include these additional novel features.

In the preferred embodiment, the array of casing gripping slips comprises four arcuate segments, the pair of slips one of which is mounted on the gate inner wall being floating segments with the other pair which are connected to the lift arms being driven segments. A pair of C-shaped members are mounted to the top of the floating segments and circumferentially project beyond the edges thereof towards the tops of the driven segments. A pair of arcuate channel members are mounted on the top of the driven segments and slideably receive the ends of the C-shaped members so that when the driven segments are moved vertically, the floating segments move with the driven segments. The C-shaped member mounted on the top of the segment which is mounted to the gage inner wall is removable to facilitate the lateral pivoting of the gage.

There is further provided a latch for releasable engaging one of the crank arms when it is rotated to its upwardmost position. The latch may be conveniently released by pulling on a lanyard, for example. The latch incorporates a tapered indent pin having latch contact surfaces which may be provided with hardened, wear resistant material. Additionally, the hardened latch plate of the crank arm defines an arcuate groove matching the external curvature of the hardened metal plate so that latching and releasing activities are efficiently accomplished and at the same time wear of the latch mechanism is minimized to promote extensive service life of the spider-elevator unit.

The cross-shaft to which the crank arms are fixed is provided with outwardly facing shoulders near each extremity of the shaft and having slightly greater spacing than the spacing of the journal bushings which support the cross-shaft during its rotation. A spacer member is received by the cross-shaft and is disposed in engagement with one of the shoulders of the cross-shaft. Jamb nuts are assembled to the opposite threaded end sections of the cross-shaft to ensure that the crank arms are disposed in fixed relation with the cross-shaft and thus prevents the crank arms from slipping longitudinally with respect to the cross-shaft and thereby minimizes the potential for the slip actuating mechanism to get out of adjustment during use.

The construction of the invention allows for a degree of safety and ease of use not heretofore available. The mechanical actuating and slip mechanism is directly accessible so that it is not necessary for a worker to reach within the bowl interior to repair or adjust the mechanism or to replace a slip. The laterally pivoting gate member provides both ease of use permitting the rapid engagement and disengagement of the mechanism with a well casing and safety to the worker since it is no longer necessary to physically shift the mechanism between extreme vertical heights with respect to the well casing.

BRIEF DESCRIPTION OF THE DRAWINGS

The foregoing and other objects, advantages and aspects of the invention will be better appreciated from the following detailed descriptions of a preferred embodiment with reference to the accompanying drawings, in which.

DESCRIPTION OF THE PREFERRED EMBODIMENT

Figure 1:
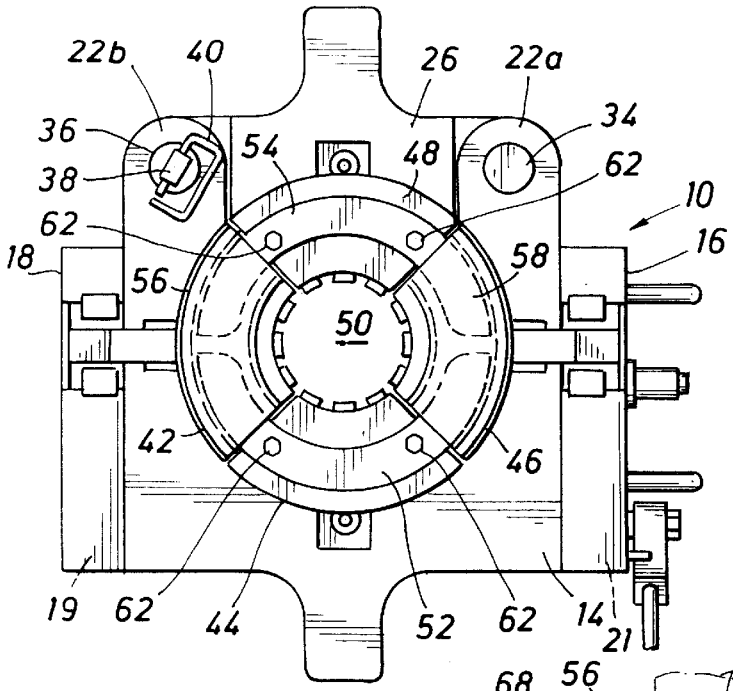
FIG. 1 is a top plan view of the combined well casing spider and elevator according to the preferred embodiment of the invention.
Figure 2:
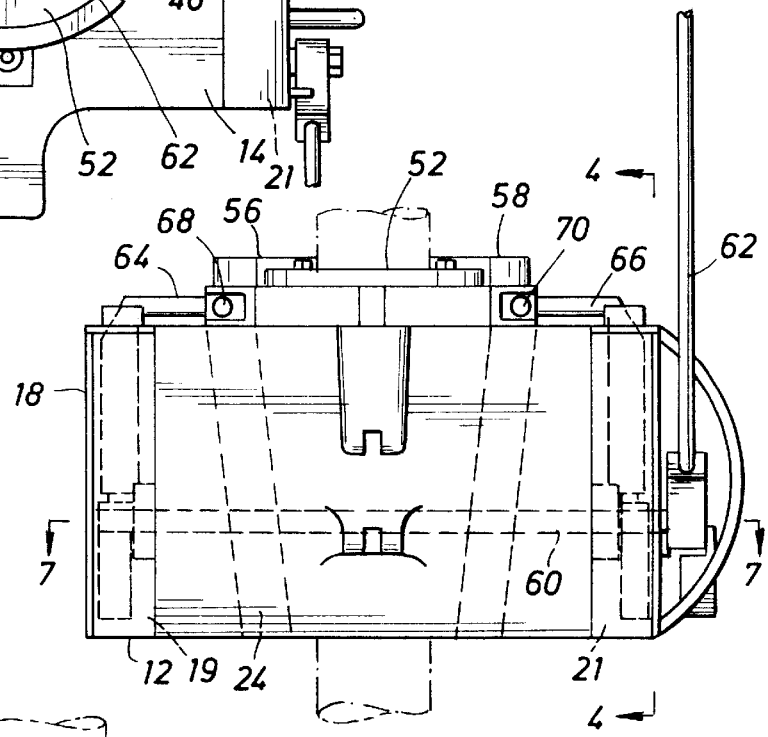
FIG. 2 is a front elevational view of the combined well casing spider and elevator.
Figure 3:
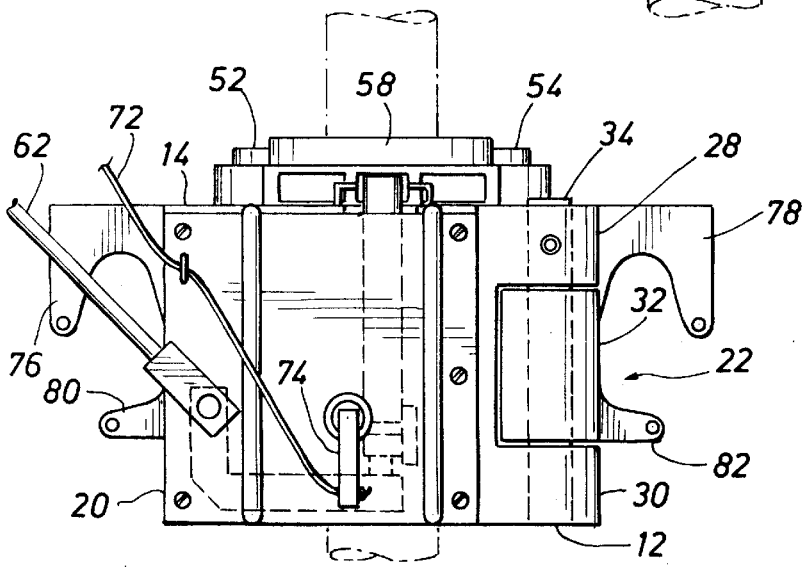
FIG. 3 is a side elevational view of the combined well casing spider and elevator.
Figure 10:
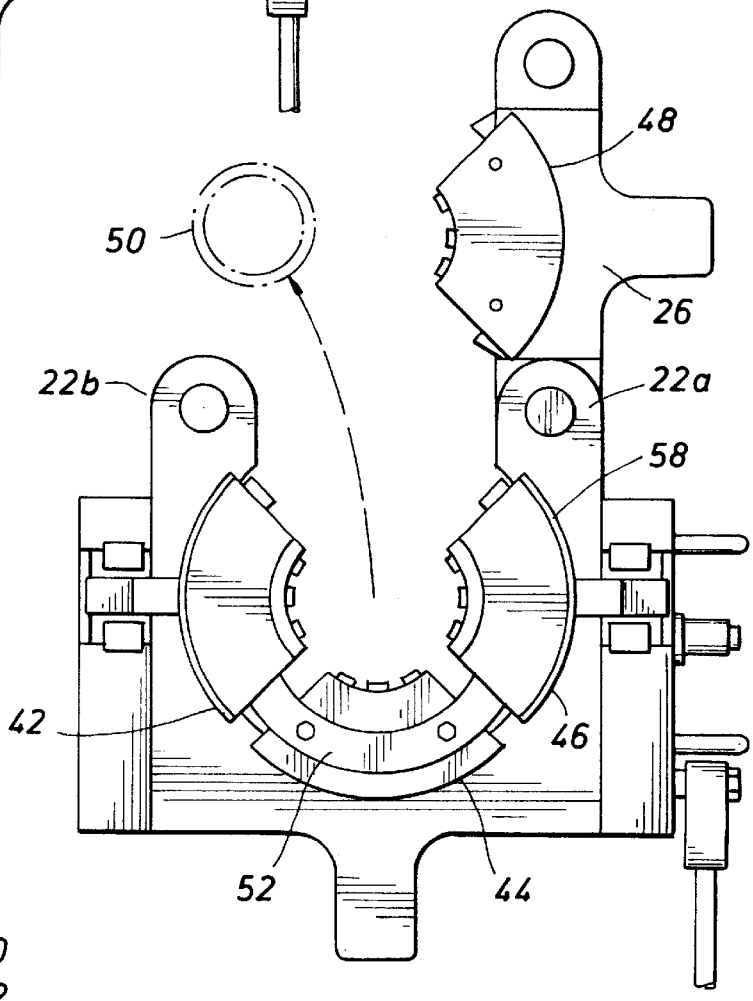
FIG. 10 is a top plan view similar to FIG. 9 but showing the gate member laterally pivoted outwardly to facilitate the insertion or removal of a well casing.

Referring first to FIGS. 1, 2 and 3 of the drawings, the combined well casing spider and elevator comprises a main body 10 having a generally square configuration and including a base wall 12, a top wall 14, a pair of lateral walls 16 and 18, a first end wall 20 and a second end wall 22. The lateral walls 16 and 18 define wall panels that are disposed in spaced relation with the main body with the space therebetween defining actuator compartments 19 and 21 on opposed sides of the main body. The second end wall 22 as best seen in FIG. 1 has two sections 22*a* and 22*b* spaced from one another. The main body may be fabricated of steel structure or steel casting and further includes a bowl inner wall 24 tapered to reduced diameter from the top wall 14 to the bottom wall 12. A gate member 26 to be described in more detail hereinafter, is pivotably secured to section 22*a* and releasably to section 22*b* as can best be seen in FIG. 1. The gate member 26 has an inner wall co-operating with the bowl inner wall 24 to comprise a bowl section. As best seen in FIG. 3, the two sections of the end wall comprise spaced flanges 28 and 30, and the gate member 27 has opposed lugs 32 projecting outwardly on opposite ends thereof. The flanges and the lugs carry bores of similar size. A pivot pin 34 projects through the bores of the flanges of section 22*a* and the aligned bore of the co-operating lug on the gate member 26 to define a pivot axis for the gate member. As shown in FIG. 1 a removable locking pin 36 is carried within the aligned bores of the flanges of section 22*b* and the co-operating lug of the gate member 26. The pin 36 has a central projection 38 at its upper end which hingedly carries a D-ring 40, permitting by grasping of the D-ring 40, the lifting of the locking pin 36 so as to release the gate member and permit it to laterally pivot outwardly to an open position as shown in FIG. 10.

Still with reference to FIGS. 1, 2 and 3, a circumferential array of casing gripping slips 42, 44, 46 and 48 are arranged in opposing pairs for vertical and radial mounting in surface contact with the bowl inner wall 24. The gripping slips form a circular hole 50 within the center thereof to receive a well casing and are vertically movable along the bowl wall 24 to effect radial enlargement and contraction of the circular holes formed thereby by upward and downward movement respectively to release and grip the casing. The casing gripping slips 42, 44, 46, and 48 comprise four arcuate segments, of which segment 48 is mounted on the gate inner wall. The gripping slips 42 and 46 which are diametrically opposed to one another are connected to a lifting mechanism and are, therefore, driven segments, while the gripping slips and 48 are also diametrically opposed to one another, are floating segments. The floating segments are, however, connected to the driven segments by circumferentially slidable couplings at their tops so that as the driven segments are moved vertically, the floating segments move with the driven segments. This arrangement allows the gripping slips 42, 44, 46 and 48 to separate circumferentially as they move radially outward with respect to the axis of the assembly and center of hole 40 formed by these members.

While the foregoing arrangement of sleeves and dowel is quite satisfactory for providing slideable couplings at the tops of the gripping slips 42, 44, 46 and 48, as shown in FIG. 1, the slidable couplings in the preferred embodiment disclosed herein are replaced by a pair of C-shaped members 52 and 54 and a pair of arcuate channels 56 and 58. More particularly, the C-shaped members have generally the same radius of curvature of the arcuate segments or gripping slips and are mounted to the tops of the floating segments and circumferentially project beyond the edges thereof towards the tops of the driven segments. C-shaped member 52 is mounted to the top of gripping slip 44 by means of, for example, bolts 62, while C-shaped member 54 is mounted to the top of gripping slip 48 by means of bolts 62. As will become apparent by the description which follows, the bolt 62 must be removed and the C-shaped member 54 dismounted from the top of gripping slip 48 to allow the gate 26 to pivot laterally. The arcuate channel members 56 and 58 also generally have the same radius of curvature as of the arcuate segments or gripping slips. The channel members 56 and 58 are mounted on the top of gripping slips 42 and 46 as by welding. However, to facilitate the ready interchangeability of the gripping slips, it is preferred to attach the channel member with bolts (not shown).

As shown in FIG. 2 the lifting mechanism which will be described in more detail with reference to other FIGS. of the drawings, comprises a cross rod 60 standing as the main body and extending into bearing journals 50 and 51 which are attached to each of the lateral walls of the main body. The cross rod 60 extends through the bearing journal 51 and the lateral wall on the right side of the main body as is evident from FIG. 7. A lever 62 is fixedly attached to the cross rod 60 and vertically movable to rotate the cross rod in its bearing journals. Upper lateral extensions of L-shaped lift arms 64 and 66 are pivotably attached at 68 and 70, respectively, to the gripping slips 42 and 46. As will become clear from the following description, pulling of the lever 62 downwardly causes a rotation of the cross rod 60 which results in the upward movement of lift arms 64 and 66. This upward movement of the lift arms 64 and 66 effects an upward movement of the entire array of casing gripping slips relative to the bowl inner wall 24.

The cross-shaft 60 defines outwardly facing shoulders 53 and 55 against which are shouldered the lower portions 57 and 59 of the lift arms 64 and 66. A jamb nut 61 which is received by a threaded end of the cross-shaft maintains the lower end of the lift arm 64 in firmly seated engagement against the shoulder 53 to thus restrain any tendency of the lift arm to move linearly relative to the cross-shaft. Likewise the lower end 59 of the lift arm 66 is firmly shouldered against the cross-shaft shoulder 55 by a jamb nut 63 which is received by the opposite threaded end of the cross-shaft and acts on a connector element 65 of the actuating lever 62 which bears against a spacer sleeve 67 positioned about the cross-shaft and interposed between the connector element 65 of the slip operating lever and the end 59 of the lift arm. Thus, the jamb nuts 61 and 63 prevent the lift arms 64 and 66 from moving linearly on the cross-shaft so that the lift arms will not have any tendency to get out of adjustment as the spider-elevator mechanism is utilized normally.

Figure 12:
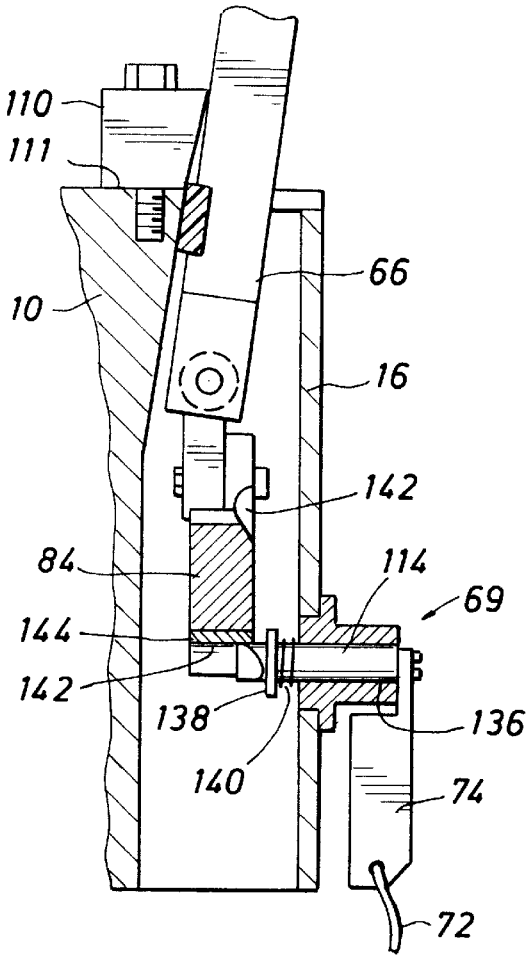
FIG. 12 is a fragmentary cross sectional view taken along the section lines in FIG. 4B showing the latching mechanism when the lift mechanism is in its upward-most position and further showing the wear resistant aspects of the latch and latch release mechanism.

When the lift arms 64 and 66 are moved to their upward-most position, the lift mechanism is releasably latched in this position by a latch mechanism shown generally at 69. The latch 69 can be released by pulling on the lanyard 72 which is attached on one end to the pivot arm 74 of the latch mechanism as shown in FIGS. 3 and 12.

With continued reference to FIG. 3, the first end wall 20 and the second end wall 22 are each provided with outwardly projected lugs 76 and 78, respectively which have a generally hook configuration. These lugs are provided for facilitating the lifting of the mechanism by means of chains, cables or the like. Below he hook shaped lugs 76 and 78 are outwardly projecting co-operating lugs 80 and 82, respectively. Holes are drilled in the ends of each of he lugs 76, 78, 80 and 82. These holes are designed to receive a safety link (not shown) which is attached after the lugs 76 and 78 have been engaged with a lifting chain or cable. More specifically, a safety link is releasably attached between the ends of lugs 76 and 80, and another safety link is releasably attached between the ends of lugs 78 and 82.

Figure 4B:
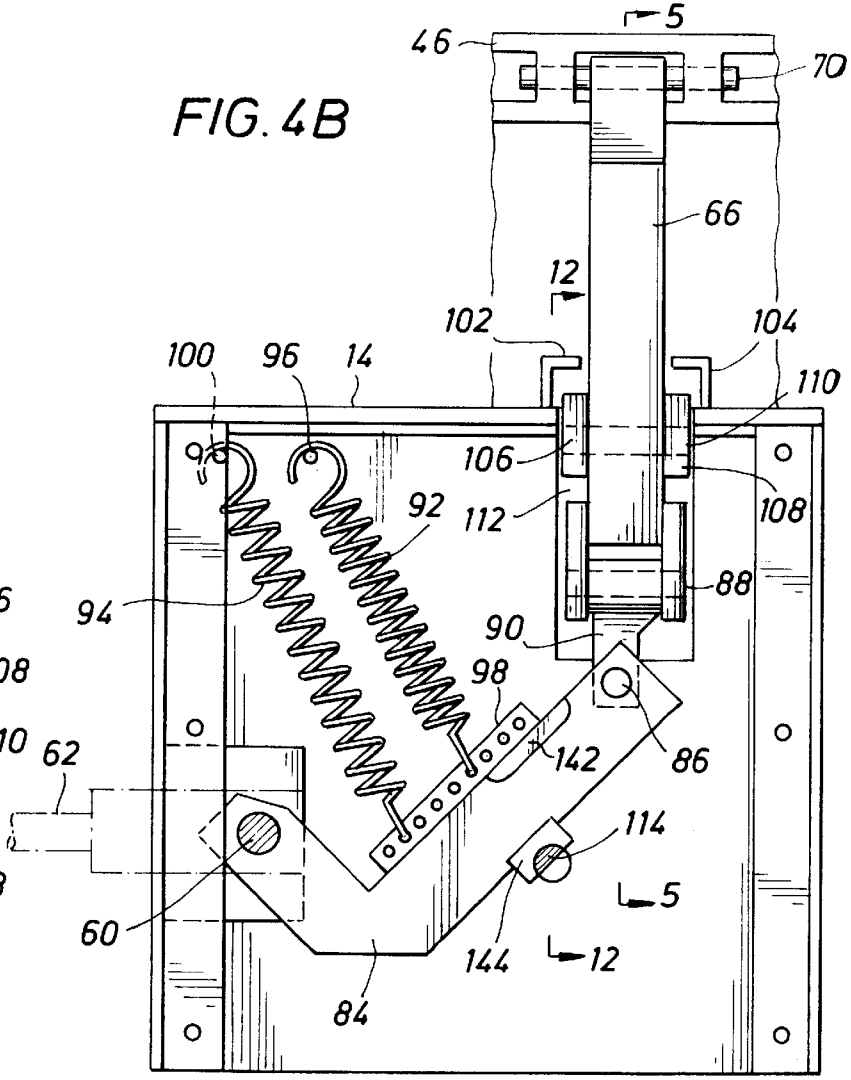
FIGS. 4A and 4B are cross sectional views taken along the section lines in FIG. 2 showing the lift mechanisms in the lowered and raised positions respectively.
Figure 4A:
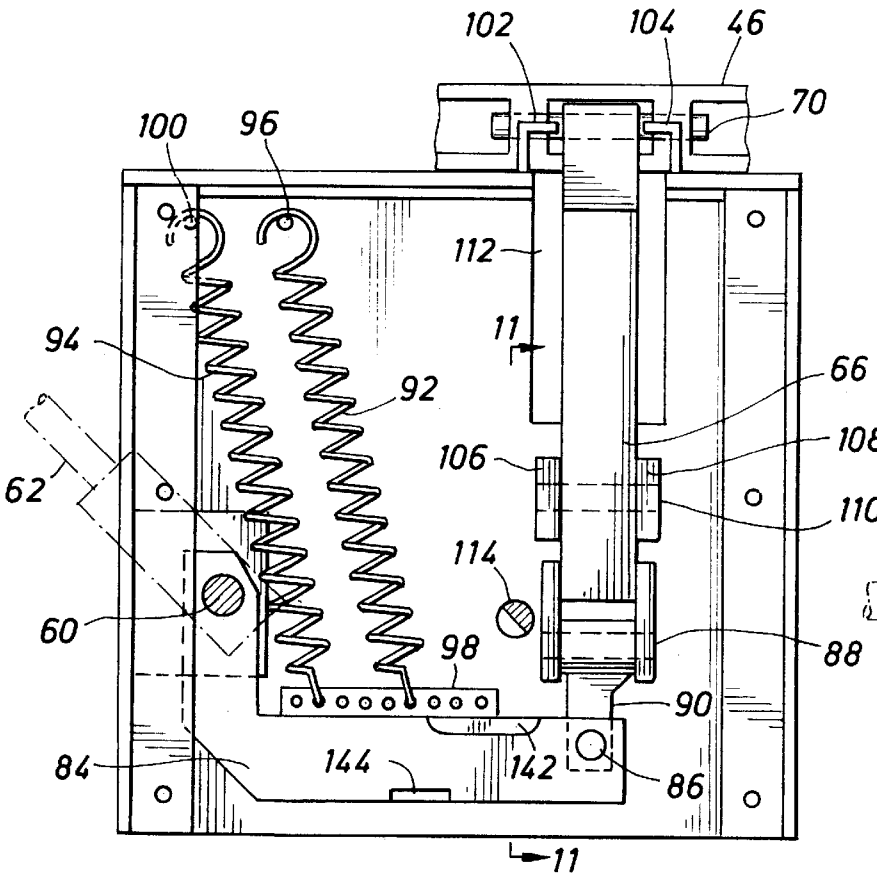
Figure 5:
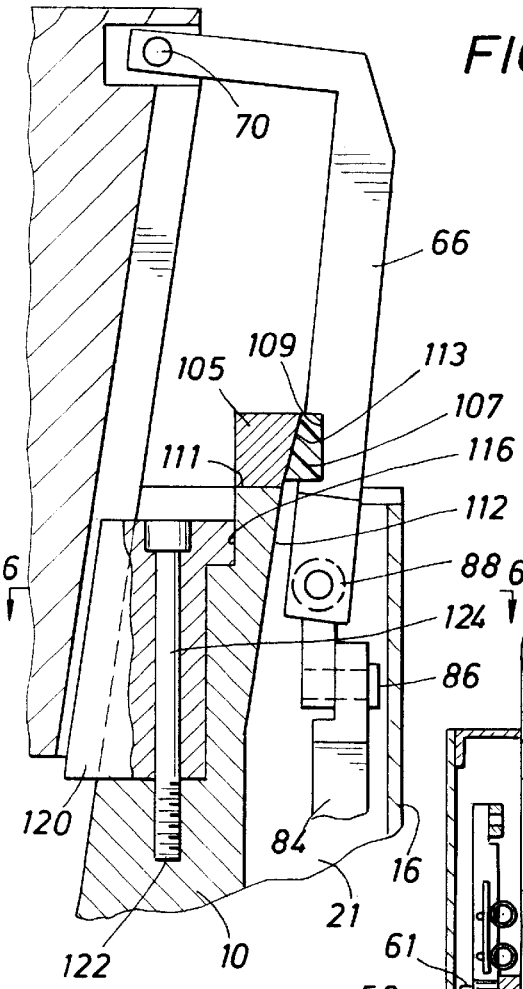
FIG. 5 is a cross sectional view taken along the section lines in FIG. 4B showing details of the key way construction and a portion of the lift mechanism with the wear resistant cam follower and with the slip opening kicker segment of the body structure being shown in detail.

The lifting mechanism is shown in more detail in the cross sectional views of FIGS. 4A, 4B and 5, to which reference is now made. As previously described the lever 62 is fixedly attached to the cross-rod 60 so that as lever 62 in FIG. 4A is pulled downwardly in FIG. 4B, the cross-rod 60 rotates in a counter-clockwise direction. A crank arm 84 is also fixedly attached to the cross-rod 60 near the lateral side 16 of the main body. Another crank arm (not shown) is also fixedly attached to the cross-rod 60 but adjacent to the lateral wall 18. These crank arms are movable with the cross-rod 60 to rotate in respective vertical planes as the lever 62 is moved vertically. The cross-rod 60 is positioned adjacent the front wall of he main body, and the crank arms extend toward the central axis of the main body between the first and second end walls 20 and 22. The crank arm 84 is pivotally connected to the end of the arm of the L-shaped lift arm 66. This is a double pivot connection having perpendicular pivot axes 86 and 88 at either end of a pivot link 90. This connection allows the lift arm 66 to not only move upwardly but also outwardly as the crank arm 84 rotates in a counter-clockwise direction about the axis of the cross-rod 60. A similar connection between the crank arm adjacent the lateral wall 18 and the lift arm 64. To aid in the manual lifting operation, lift springs 92 and 94 are provided. Spring 92 is connected at one end to a pin 96 mounted on the lateral wall 16 and at the other end to a hole in a plate 98 welded to the top of the crank arm 84. The spring 94 is connected at one end to a pin 100 mounted to the lateral wall 16 and at the other end to a hole in the plate 98. The plate 98 is provided with a plurality of holes allowing the springs 92 and 94 to be attached at different positions so that the desired spring tension can be attained. The spring bias of the springs 92 and 94 as to help lift the crank arm 84 as the lever 62 is moved vertically downward. Thus, as shown in FIG. 4A, the springs 92 and 94 are extended while in 4B the springs are contracted.

As the crank arm 84 rotates in a counter-clockwise direction above to the axis of the cross-rod 60, the lift arm 66 moves upwardly and outwardly. This movement is guided in part by L-shaped brackets 102 and 104 welded to the top wall 12 on either side of an opening through which the lift arm 66 projects. Further, as shown in detail in FIG. 5, the lift arm 66 is provided with a pair of rollers 106 and 108 mounted on either side thereof to rotate about a pivot 110 having an axis offset toward the inner face of the lift arm 66. The lift arm also supports a guide block 107 which is mounted within a recess 109 and which is positioned for contact with a first inclined cam surface 112 which is defined by an interior surface of he main body. Thus, as the lift arm 66 moves upwardly, the guide block 107 having camming reaction with the inclined cam surface 112 causes the lift arm 66 to move outwardly and move pivotally about its pivot 88 to thus cause spreading of the lift arms. While not shown, it will be understood that a similar construction exists for the lift mechanism connecting it to the lift arm 64 adjacent the lateral wall 18. The low friction guide block 107 is composed of a suitable low friction and wear resistant preferably polymer material such as Nylon, Delrin and the like which has the capability for serving a camming function and resisting wear even when subjected to abrasive particulate such as is typically on and about the working floor of a drilling rig. Additionally, the guide block 107 provides a scraping activity during its movement along the first inclined cam surface 112 so that any accumulation of grease laden with particulate is scraped away and does not have the tendency for entry into the contact interface between the guide block and the cam surface.

It is desirable as indicated above to overcome any tendency of the upper ends of the slips to tilt radially inwardly to positions potentially interfering with entry of downwardly moving casing into the central opening of the spider mechanism and perhaps causing impact that might damage the slips, the casing or both. It is also desirable to cause significant expansion of the central opening of the spider, by spreading of the slips, to ensure against slip interference with the casing as the casing enters and moves through the central opening during running and retrieval of the casing. This feature is accomplished by providing the main body 10 with a kicker block segment or element 105 which is bolted, welded or otherwise fixed to the upper end surface 111 of the main body. The kicker block element may be formed integrally with the main body, such as for originally manufactured equipment or it may be defined by a metal block which is fixed in any suitable manner to the main body such as in the case of altering exising equipment. The kicker block 105 defines a second inclined cam surface 113 which has greater upward and outward inclination as compared with that of the first inclined cam surface 112. The guide blocks undergo a first segment of spreading movement during movement thereof along the first inclined cam surface and undergo a second segment of spreading movement during movement thereof along the second inclined cam surface 113. When the guide blocks leave the first inclined cam surfaces, which cause pivotal spreading of the lift arms and thus the slips, and move onto the second inclined cam surfaces, the upper ends of the slips will become significantly moved radially outwardly and thus significantly spread so that inward tilting of the slips cannot occur. Also, the greater inclination of the second cam surfaces causes significant slip spreading to occur, without any need for lengthening the slips and without significantly adding to the overall height of the spider mechanism.

As the crank arm 84 rotates in a counter-clockwise direction, it passes a spring loaded indent pin 114 which engages the bottom edge of the crank arm 84 to latch the lift mechanism in its uppermost position. This latch mechanism is described in more detail with reference to FIGS. 11 and 12 hereinafter.

Figure 6:
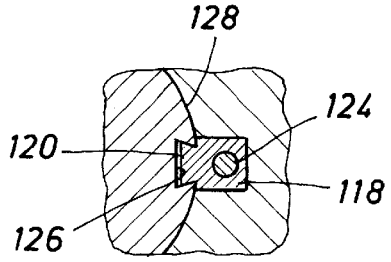
FIG. 6 is a fragmentary cross sectional view taken along the section lines in FIG. 5 showing another view of the key way construction.

Referring now to FIGS. 5 and 6, the upper end of the tapered surface of the bowl inner wall 24 is provided with recesses 116 at circumferentially spaced locations to receive rectangular blocks 118 which include a key 120 projecting outwardly from a surface portion or side wall which is parallel and constitutes an extension of the tapered surface of the bowl inner wall 24. A vertical bore 122 is tapped and threaded to receive a bolt 124 which rigidly mounts block 118 within the recess 116. The keys 120 fit within keyways 126 of like dovetail horizontal cross-section provided within confronting radially outer surfaces 128 of individual gripping slips 42, 44, 46 and 48.

Figure 7:
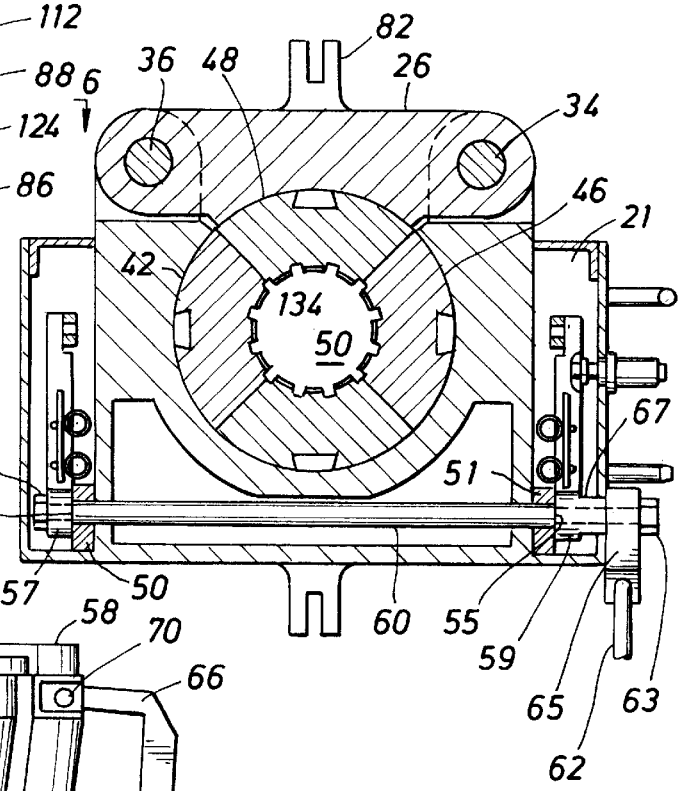
FIG. 7 is a cross sectional view taken along the section lines in FIG. 2 showing the interior construction of the combined well casing spider and elevator according to the preferred embodiment and showing the cross-shaft, journal bushing and jamb controlled crank arm alignment mechanism in detail.

FIG. 7 shows the combined well casing spider and elevator according to the preferred embodiment of the invention in cross section taken through the section lines 7—7 shown in FIG. 2. This view shows in more detail the cross-rod 60 extending through bearing journals 50 and 51 which are attached to the lateral walls of the main body. It will also be observed in this view that a crank arm 65 similar to crank arm 84 is attached to the opposite end of cross-rod 60. The gripping slips 42, 44, 46 and 48 are identical segments and readily interchangeable. The radially inner surface 134 of each of the gripping slips bears parallel, narrow, radially outward projecting ribs which are serrated to grip the well casing.

Figure 8:
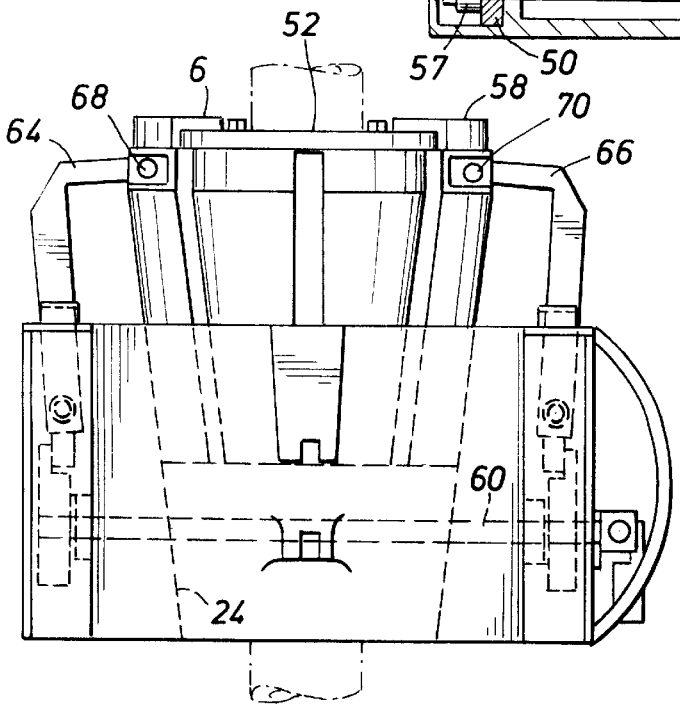
FIG. 8 is a front elevation view showing the gripping slips and of their raised position.
Figure 9:
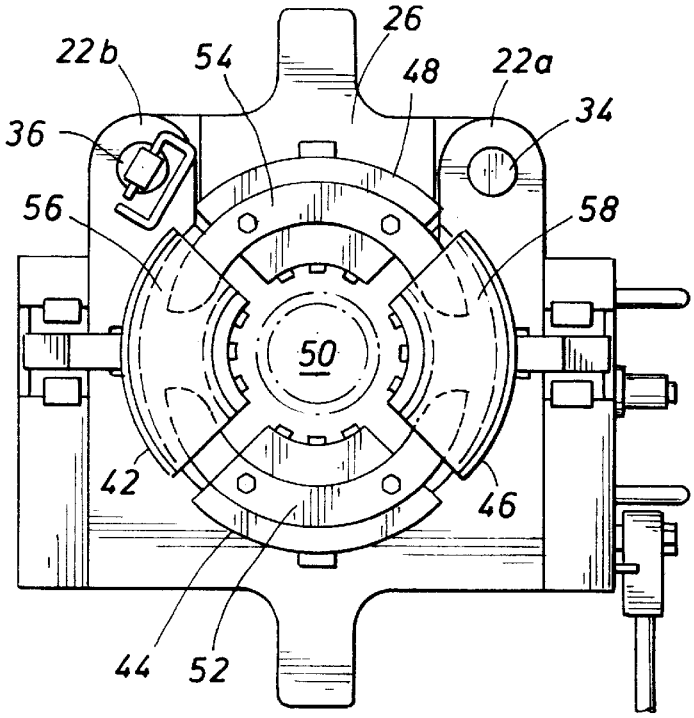
FIG. 9 is a top plan of view also showing the gripping slips in their raised position.

FIGS. 8 and 9 are front elevation and top plan views respectively showing the combined well casing spider and elevator with the lift mechanism in its uppermost position as shown in more detail in FIG. 4B. The corresponding views with the lift mechanism in its lower most position corresponding to the detailed view shown in FIG. 4A are FIGS. 2 and 1 respectively. The lift mechanism may be in either the upper or lower positions when the gate member 26 is laterally pivoted outwardly to permit the lateral entry of a well casing within the area defined by the bowl inner wall 24. FIG. 10 shows the gate member pivoted outwardly when the lift mechanism is in its uppermost position so that the gripping slips are circumferentially separated from one another. In order to release the gate member 26 it is first necessary to remove bolts 62 and dismount the C-shaped member 54 from the top of the gripping slip 48. Then, the D-ring 40 attached to the top of locking pin 36 is grasped and pulled to remove the locking pin thereby allowing the gate member 26 to be laterally pivoted outwardly as shown in FIG. 10. This in turn allows the lateral insertion or removal of a well casing thereby avoiding the necessity of shifting the mechanism vertically as was necessary in the prior art.

Figure 11:
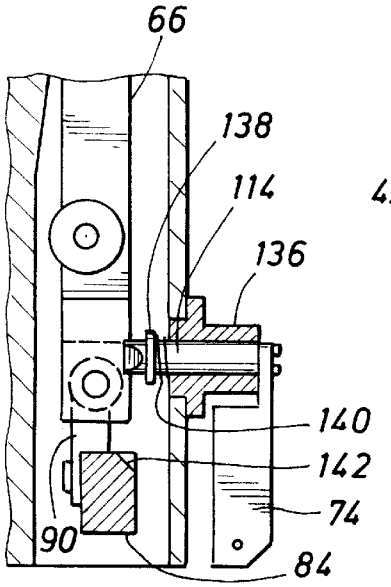
FIG. 11 is a fragmentary cross sectional view taken along the section lines shown in FIG. 4A showing the latching mechanism in its lowermost position.
Figure 12A:
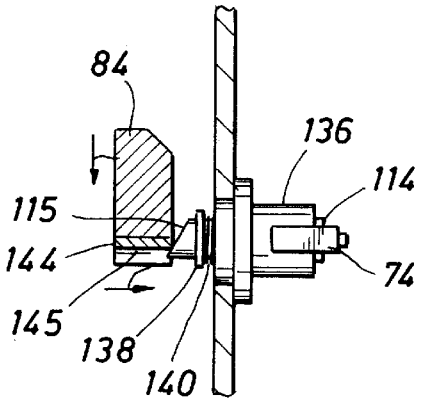
FIG. 12A is a detailed view taken from FIG. 12 showing the manner in which the latching mechanism is released and further showing the wear resistant aspects of the latch mechanism.
Figure 12B:
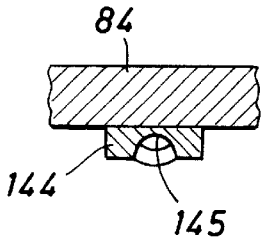
FIG. 12B is a fragmentary end view showing the latch mechanism and further emphasizing the wear resistant aspects of the latch mechanism.

With particular reference now to FIGS. 11, 12 and 12A, the latching mechanism 69 comprises an indent pin 114 having a tapered end surface 115 and being mounted within a housing 136 attached to the lateral wall 16. The indent pin projects through the lateral wall 16 and slightly beyond the crank arm 84. A washer 138 is fixed to the pin 114 by welding or the like and acts as a stop for spring 140, the other stop for the spring being the wall 16. The crank arm 84 is provided with a hardened steel plate or block 144 which defines a camming surface 142 which engages the tapered end 115 of the indent pin 114 causing it to rotate and to be retracted as the crank arm 84 moves vertically upward form the position shown in FIG. 11 to that shown in FIG. 12. The hardened steel plate 144 defines an arcuate recess or slot 145 having the same radius of curvature as that of the indent pin 114 so that the indent pin establishes mating surface-to-surface contact with the curved surface defined by the recess or slot 145. This mating surface-to-surface contact between the indent pin and the hardened wear resistant block or plate member 144 ensures extensive service life of the latch mechanism even when actuated under significant load between the latch and the spring operated crank arm. Once the crank arm 84 passes the pin 114, the spring 140 urges the pin to return to its original orientation to engage the bottom edge of the crank arm 84 to prevent its movement downwardly. Where the crank arm 84 engages the indent pin 114, the crank arm is provided with a hardened steel plate 144. The end of pin 114 also has a camming surface 115, but this camming surface is normally directed away from the crank arm 84 when the crank arm 84 is in its upwardmost position. The indent pin 114, however, is rotatable by means of the latch release arm 74 which is attached to the end of the pin 114 which projects out of the housing 136. When the arm 74 is pulled by lanyard 72, the indent pin 114 rotates against the spring bias so as to present its camming surface 115 to the bottom edge of the crank arm 84 as shown in FIG. 12A. In this position, the downward force of the crank arm due to the weight it supports causes the indent pin 114 to be retracted against the bias of spring 140 so that the crank arm can move vertically downward to a position past the indent pin.

Figure 13:
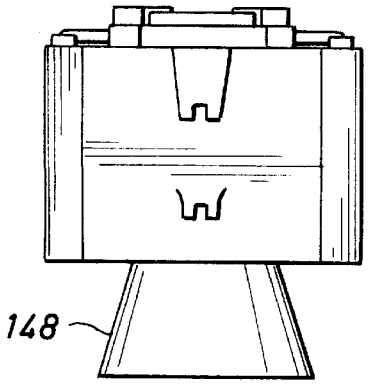
FIG. 13 is a simplified front elevational view of the combined well casing spider and elevator fitted with a bell housing for use as an elevator; and, FIG 14 is a simplified elevational view showing the combined well casing spider and elevator fitted with a base member for use as a spider.
Figure 14:
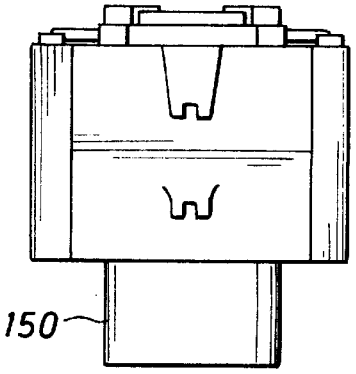

As may be appreciated, the unusually compact design of he mechanism allows it to be used as either a well casing spider or elevator. When used as an elevator, it is merely necessary to attach a bell housing 148 to the bottom wall of the main body as shown in FIG. 13. The bell housing 148 serves as a guide to properly direct a well casing into the circular hole defined by the gripping slips. On the other hand, when used as a spider, a base member 150 is attached to the base wall as shown in FIG. 14, this base member co-operating with the rotary table in the platform of the well drilling derrick.

While the invention has been particularly shown and described with reference to a preferred embodiment thereof, it will be understood by those skilled in the art that various changes in form and details may be made therein without departing from the spirit and scope of the invention.

I claim:

1. A combined well casing spider and elevator comprising:

(a) a body defining a top and bottom ends and defining a bowl inner wall tapered to reduced diameter from the top end to the bottom end, said body defining a first external guide surface being inclined upwardly and outwardly and defining a second external guide surface being coextensive with said first external guide surface and being inclined upwardly and outwardly to a greater extent as compared with said first external guide surface;

(b) a gate member pivotally secured to said body and being movable between an open position permitting lateral movement of a well casing into said bowl and a closed position securing the well casing within said bowl;

(c) a circumferential array of casing gripping slips arranged in opposing pairs for vertical and radial mounting in surface contact with said bowl inner wall, said gripping slips forming a circular hole within the center thereof to receive a well casing and vertically movable along the bowl inner wall to effect radial enlargement and contraction of the circular hole formed thereby upward and downward movement respectively to release and grip the casing;

(d) a slip actuating mechanism having a cross-rod extending across said body and having end portions rotatably received within journal bushings fixed within said body;

(e) crank arms being fixed to said cross-rod and having lift arms connected thereto and being moved thereby, said lift arms being connected with said circumferential array of casing gripping slips for raising and lowering thereof responsive to rotation of said cross-rod and said crank arms; and (f) guide pad means being fixed to said lift arms and having guiding engagement with said first and second external guide surfaces during upward movement of said lift arms and causing first and second segments of upward spreading movement of said lift arms during upward movement thereof to thus cause first and second segments of upward and radially spreading movement of said circumferential array of casing gripping slips.

2. The combined well casing spider and elevator of claim 1, wherein:

said guide pad means being a wear resistant pad element being fixed to each of said lift arms and being positioned for contact with said first and second external guide surfaces during upward and downward movement of said lift arms.

3. The combined well casing spider and elevator of claim 1, wherein:

(a) said lift arms each defining a guide pad seat; and (b) said guide pad means being a pair of guide pads composed of low friction wear resistant material being seated within said guide pad seats and having guide surfaces disposed for guiding engagement with said first and second guide surfaces of said body.

4. The combined well casing spider and elevator of claim 3, wherein:

said guide pads being composed of friction resistant polymer material.

5. The combined well casing spider and elevator of claim 1, wherein:

said body having kicker projections extending upwardly from said top end thereof, said kicker projections defining said second guide surfaces.

6. The combined well casing spider and elevator of claim 5, wherein:

said kicker projections being integral with said body.

7. The combined well casing spider and elevator of claim 5, wherein:

said kicker projections being fixed to said body.

8. The combined well casing spider and elevator of claim 1, wherein:

(a) said cross-rod defining outwardly facing positioning shoulders and having threaded ends;

(b) said crank arms being non-rotatably received by said cross-rod and being seated against said outwardly facing positioning shoulders; and (c) a pair of jamb nuts being received by said threaded ends of said cross-rod and securing said crank arms firmly seated against said positioning shoulders of said cross-rod and preventing linear misaligning movement of said crank arms on said cross-rod during use of said well casing spider and elevator.

9. The combined well casing spider and elevator of claim 8, wherein:

(a) spacer means being disposed in engagement with one of said outwardly facing shoulders;

(b) an actuating lever having a lever connector, said lever connector being received in non-rotatable relation by said cross-rod and having contact with said spacer means; and (c) one of said jamb nuts bearing against said lever connector and applying positioning force to said lever connector and through said spacer means to said crank arm to secure said crank arm in position against said one of said outwardly facing shoulders.

10. The combined well casing spider and elevator of claim 1, wherein:

(a) housing means being located externally of said body and being in spaced relation with said body for defining actuator compartment means;

(b) said crank arms and said lift arms being disposed within said actuator compartment means;

(c) said cross-rod defining outwardly facing positioning shoulders and having threaded ends;

(d) said crank arms being non-rotatably received by said cross-rod and being seated against said outwardly facing positioning shoulders; and (e) a pair of jamb nuts being received by said threaded ends of said cross-rod and securing said crank arms firmly seated against said positioning shoulders of said cross-rod and preventing linear misaligning movement of said crank arms on said cross-rod during use of said well casing spider and elevator.

11. The combined well casing spider and elevator of claim 10, wherein:

(a) spacer means being disposed in engagement with one of said outwardly facing shoulders;

(b) an actuating lever having a lever connector, said lever connector being received in non-rotatable relation by said cross-rod and having contact with said spacer means; and (c) one of said jamb nuts bearing against said lever connector and applying positioning force to said lever connector and through said spacer means to said crank arm to secure said crank arm in position against said one of said outwardly facing shoulders.

12. The combined well casing spider and elevator of claim 1, wherein:

(a) housing means being located externally of said body and being in spaced relation with said body for defining actuator compartment means;

(b) said crank arms and said lift arms being disposed within said actuator compartment means, at least one of said crank arms defining a camming surface exposed to said actuating compartment;

(c) a wear resistant element being fixed to at least one of said crank arms and defining a latching groove of arcuate cross-sectional configuration;

(d) an indent pin being supported by said housing means for rotary and linear movement relative to said housing means and defining a tapered cam engaging surface, said indent pin further defining an arcuate external surface having mating surface-to-surface engagement within said latching groove in the latched condition of said indent pin;

(e) means for rotating said indent pin between latching and releasing positions thereof; and (f) a compression spring urging said indent pin in a direction toward said crank arm and moving said indent pin into camming engagement with said camming surface.

13. The combined well casing spider and elevator of claim 12, wherein:

(a) a latch housing being fixed to said housing means and defining a latch bore;

(b) said indent pin being located within said through bore and located with said tapered end being located within said actuator compartment and with an actuated end thereof being located externally of said housing means; and (c) a latch actuator being fixed to said actuated end of said indent pin and being rotatable about said pin for moving said indent pin between latching and releasing positions.

14. A combined well casing spider and elevator comprising:

(a) a body defining a top and bottom ends and defining a bowl inner wall tapered to reduced diameter from the top end to the bottom end, said body defining a first external guide surface being inclined upwardly and outwardly and having kicker projections extending upwardly from said top end thereof, said kicker projections defining second external guide surfaces being coextensive with said first external guide surface and being inclined upwardly and outwardly to a greater extent as compared with said first external guide surface;

(b) a gate member pivotally secured to said body and being movable between an open position permitting lateral movement of a well casing into said bowl and a closed position securing the well casing within said bowl;

(c) a circumferential array of casing gripping slips arranged in opposing pairs for vertical and radial mounting in surface contact with said bowl inner wall, said gripping slips forming a circular hole within the center thereof to receive a well casing and vertically movable along the bowl inner wall to effect radial enlargement and contraction of the circular hole formed thereby upward and downward movement respectively to release and grip the casing;

(d) a slip actuating mechanism having a cross-rod extending across said body and having end portions rotatably received within journal bushings fixed within said body;

(e) crank arms being fixed to said cross-rod and having lift arms connected thereto and being moved thereby, said lift arms being connected with said circumferential array of casing gripping slips for raising and lowering thereof responsive to rotation of said cross-rod and said crank arms; and (f) at least one wear resistant guide pad being fixed to each of said lift arms and having guiding engagement with said first and second external guide surfaces during upward movement of said lift arms and causing first and second segments of upward spreading movement of said lift arms for first and second segments of upward and radially spreading movement of said circumferential array of casing gripping slips.

15. The combined well casing spider and elevator of claim 14, wherein:

(a) said lift arms each defining a guide pad seat; and (b) said guide pads being composed of low friction polymer wear resistant material being seated within said guide pad seats and having guide surfaces disposed for guiding engagement with said first and second guide surfaces of said body.

16. The combined well casing spider and elevator of claim 14, wherein:

(a) said cross-rod defining outwardly facing positioning shoulders and having threaded ends;

(b) said crank arms being non-rotatably received by said cross-rod and being seated against said outwardly facing positioning shoulders; and (c) a pair of jamb nuts being received by said threaded ends of said cross-rod and securing said crank arms firmly seated against said positioning shoulders of said cross-rod and preventing linear misaligning movement of said crank arms on said cross-rod during use of said well casing spider and elevator.

17. The combined well casing spider and elevator of claim 16, wherein:

(a) spacer means being disposed in engagement with one of said outwardly facing shoulders;

(b) an actuating lever having a lever connector, said lever connector being received in non-rotatable relation by said cross-rod and having contact with said spacer means; and (c) one of said jamb nuts bearing against said lever connector and applying positioning force to said lever connector and through said spacer means to said crank arm to secure said crank arm in position against said one of said outwardly facing shoulders.

18. The combined well casing spider and elevator of claim 14, wherein:

(a) housing means being located externally of said body and being in spaced relation with said body for defining actuator compartment means;

(b) said crank arms and said lift arms being disposed within said actuator compartment means;

(c) said cross-rod defining outwardly facing positioning shoulders and having threaded ends;

(d) said crank arms being non-rotatably received by said cross-rod and being seated against said outwardly facing positioning shoulders;

(e) a pair of jamb nuts being received by said threaded ends of said cross-rod and securing said crank arms firmly seated against said positioning shoulders of said cross-rod and preventing linear misaligning movement of said crank arms on said cross-rod during use of said well casing spider and elevator;

(f) spacer means being disposed in engagement with one of said outwardly facing shoulders;

(g) an actuating lever having a lever connector, said lever connector being received in non-rotatable relation by said cross-rod and having contact with said spacer means; and (h) one of said jamb nuts bearing against said lever connector and applying positioning force to said lever connector and through said spacer means to said crank arm to secure said crank arm in position against said one of said outwardly facing shoulders.

19. The combined well casing spider and elevator of claim 14, wherein:

(a) housing means being located externally of said body and being in spaced relation with said body for defining actuator compartment means;

(b) said crank arms and said lift arms being disposed within said actuator compartment means, at least one of said crank arms defining a camming surface exposed to said actuating compartment;

(c) a wear resistant element being fixed to at least one of said crank arms and defining a latching groove of arcuate cross-sectional configuration;

(d) an indent pin being supported by said housing means for rotary and linear movement relative to said housing means and defining a tapered cam engaging surface, said indent pin further defining an arcuate external surface having mating surface-to-surface engagement within said latching groove in the latched condition of said indent pin;

(e) means for rotating said indent pin between latching and releasing positions thereof; and (f) a compression spring urging said indent pin in a direction toward said crank arm and moving said indent pin into camming engagement with said camming surface.

20. The combined well casing spider and elevator of claim 19, wherein:

(a) a latch housing being fixed to said housing means and defining a latch bore;

(b) said indent pin being located within said through bore and located with said tapered end being located within said actuator compartment and with an actuated end thereof being located externally of said housing means; and (c) a latch actuator being fixed to said actuated end of said indent pin and being rotatable about said pin for moving said indent pin between latching and releasing positions.

* * * * *